United States Patent [19]

Lok et al.

[11] Patent Number: 4,861,703

[45] Date of Patent: Aug. 29, 1989

[54] CYCLIC DICHALCOGENIDE FOG INHIBITING AGENTS FOR SILVER HALIDE PHOTOGRAPHY

[75] Inventors: Roger Lok, Hilton, N.Y.; Wolfgang H. H. Gunther, Westchester, Pa.; John P. Freeman, Beverly, Mass.

[73] Assignee: Eastman Kodak Company, Rochester, N.Y.

[21] Appl. No.: 232,255

[22] Filed: Aug. 15, 1988

[51] Int. Cl.[4] ..... G03C 1/34

[52] U.S. Cl. ..... 430/608; 430/614; 430/615; 549/332

[58] Field of Search ..... 430/608, 614, 615

[56] References Cited

U.S. PATENT DOCUMENTS

| | | | |
|---|---|---|---|
| 3,689,273 | 9/1972 | Willems et al. | 430/603 |
| 4,607,000 | 8/1986 | Gunther et al. | 430/428 |
| 4,607,001 | 8/1986 | Lok et al. | 430/428 |
| 4,699,873 | 10/1987 | Takahashi et al. | 430/446 |

FOREIGN PATENT DOCUMENTS

| | | |
|---|---|---|
| 57-81778 | 5/1978 | Japan . |
| 1282303 | 7/1972 | United Kingdom . |
| 1336570 | 11/1973 | United Kingdom . |

OTHER PUBLICATIONS

Gunther et al., Annals New York Academy of Sciences, 192, pp. 25–43 (1972).

*Primary Examiner*—Paul R. Michl
*Assistant Examiner*—Janet C. Baxter
*Attorney, Agent, or Firm*—Joshua G. Levitt

[57] ABSTRACT

Radiation-sensitive silver halide photographic elements are disclosed which are protected against fog by cyclic dichalcogenides. A new cyclic oxaspiro ditelluride is disclosed.

9 Claims, No Drawings

CYCLIC DICHALCOGENIDE FOG INHIBITING AGENTS FOR SILVER HALIDE PHOTOGRAPHY

FIELD OF THE INVENTION

This invention relates to the stabilization of photographic elements and compositions and to compounds useful for that purpose. More particularly it relates, in one aspect, to the stabilization of silver halide compositions against fog with cyclic dichalcogenides. In another aspect, the invention relates to certain new cyclic oxaspiro ditellurides which are useful in stabilizing light sensitive silver halide emulsions and layers of photographic elements.

BACKGROUND OF THE INVENTION

In the course of processing a photographic element containing an imagewise exposed silver halide emulsion layer, reduced silver can be formed either as a direct or inverse function of exposure. At the same time, at least a low level of reduced silver formation also occurs independently of imagewise exposure. The term "fog" is herein employed to indicate the density of the processed photographic element attributable to the latter, usually measured in minimum density areas. In color photography fog is typically observed as image dye density rather than directly as silver density.

Over the years a variety of differing materials have been introduced into silver halide emulsions to inhibit the formation of fog. *Research Disclosure,* Vol. 176, December 1978, Item 17643, Section VI, lists the more commonly employed fog inhibiting agents. *Research Disclosure* is published by Kenneth Mason Publications, Ltd., The Old Harbourmaster's, 8 North Street, Emsworth, Hampshire P010 7DD, England.

It is known to employ as fog inhibiting agents compounds having two aromatic nuclei linked by two divalent sulfur atoms and analogous compounds in which one or both of the sulfur atoms are replaced by selenium atoms. Exemplary of such fog inhibiting agents are those disclosed by Millikan et al U.S. Pat. No. 3,397,986, Pollet et al U.K. Specification No. 1,282,303, and Herz et al U.S. Pat. No. 3,811,896 and French Patent No. 2,135,176. While the two Herz et al patents are counterparts, the French patent contains pertinent subject matter which is not common to both.

Lelenthal et al U.S. Pat. Nos. 4,144,062 and 4,152,155 disclose photothermographic imaging systems employing an oxidizing agent and a reducing agent in combination with a catalyst, which in one form can be silver halide. The oxidizing agent is an organotellurium (II) or (IV) compound which in one form can be comprised of two aromatic nuclei linked by two divalent tellurium atoms. Compared to the catalyst, the oxidizing agent is present in relatively high concentrations.

Asahi Japanese Kokai 57817/78, laid open May 25, 1978, discloses the use of a variety of tellurium compounds as chemical sensitizers for silver halide emulsions. In one variety of differeing forms the tellurium compounds can satisfy the formula $$R_1—Te—Te—R_2$$

wherein $R_1$ and $R_2$ are organic groups, such as substituted or unsubstituted alkyl or aryl groups or carbonyl containing organic groups.

Gunther et al. U.S. Pat. No. 4,607,000 and Lok et al. U.S. Pat. No. 4,607,001 disclose radiation-sensitive silver halide photographic elements which are protected from fog by certain noncyclic aromatic tellurochalcogenides represented by the formula $$Ar—Te—Ch—Ar'$$

wherein Ar and Ar' are optionally substituted aromatic nuclei, and Ch is a chalcogen atom.

Pollet et al. GB Patent No. 1,282,303 discloses compounds of the formula $R^1$—Q—Se—$R^2$, wherein Q stands for either sulfur or selenium as emulsion antifoggants.

Willems et al. U.S. Pat. No. 3,689,273 relates to the use of triselenides and trisulfides as chemical sensitizers.

Brown et al. GB Patent No. 1,336,570 teaches the use of bis(1,2,3-triazol-3-yl)diselenides as storage stabilizers.

Gunther et al. Ann. N.Y. Acad. Sci., 192,25–43 (1972) relates to synthetic approaches to polydiselenides.

The prior art has not recognized the usefulness of cyclic dichalcogenides as antifogging agents in photographic silver halide materials.

SUMMARY OF THE INVENTION

It is an object of this invention to provide photographic elements containing radiation-sensitive silver halide emulsions to produce photographic images exhibiting low levels of fog while avoiding sensitization attributable to the presence of a fog inhbiting agent.

It is another object of this invention to provide photographic elements in which the fog inhibiting agent concentration is reduced as compared to known dichalcogenides fog inhibiting agents.

The present invention is based on the discovery that cyclic dichalcogenide compounds having two adjacent divalent middle chalcogen atoms, wherein at least one of the two adjacent chalcogen atoms is a selenium or a tellurium atom, are particularly effective fog inhibiting agents for silver halide emulsions. Such compounds are hereinafter collectively referred to as cyclic dichalcogenides. In one preferred form, in which the two divalent chalcogen atoms are selenium atoms, the compounds are hereinafter referred to as cyclic diselenides. In another preferred form, in which the two divalent chalcogen atoms are tellurium atoms, the compounds are hereinafter referred to as cyclic ditellurides. In additional forms, in which one of the two divalent chalcogen atoms is a sulfur atom and the other is a selenium or tellurium atom, the compounds are hereinafter referred to as cyclic thiaselenides or cyclic thiatellurides, respectively.

Except for the oxaspiro ditelluride, the compounds useful as fog inhibiting agents in the practice of this invention can be chosen from known cyclic dichlacogenides. The oxaspiro ditelluride is a novel compound.

DESCRIPTION OF PREFERRED EMBODIMENTS

The fog inhibiting agents employed in the practice of this invention can be represented by the general formula:

I

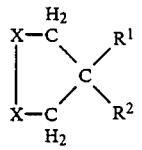

wherein each X represents a divalent sulfur, selenium or tellurium atom, at least one X is a selenium atom or a tellurium atom;

$R^1$ and $R^2$ each independently represent an alkyl, aralkyl or aryl group having from 1 to 20 carbon atoms, preferably from 1 to 5 carbon atoms, optionally substituted with, e.g., an alkyl, aryl, hydroxyl, alkoxy or ester group, or a halogen atom; or $R^1$ and $R^2$ together form a cyclic alkylene or ether group having from 1 to 20 carbon atoms, preferably from 1 to 5 carbon atoms.

Preferred fog inhibiting agents employed in the practice of this invention can be represented by general formula:

II

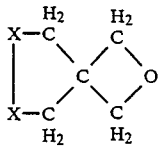

wherein X represents a divalent selenium or tellurium atom.

Specific cyclic dichalcogenides within the scope of this invention are shown below:

4,4-dimethyl-1,2-diselenolane — Compound (I-a)

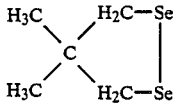

4-methyl-4-phenyl-1,2-diselenolane — Compound (I-b)

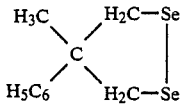

4,4-bis(hydroxymethyl)-1,2-diselenolane — Compound (I-c)

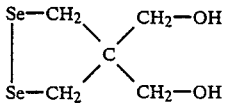

2-thia-3-selenaspiro[4.5]decane — Compound (I-d)

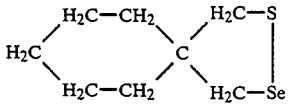

2,3-diselenaspiro[4.5]decane — Compound (I-e)

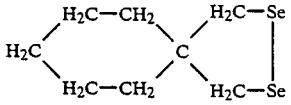

A specific oxaspiro diselenide and a specific oxaspiro dietlluride of the invention are represented by the following structural formulae (II-a) and (II-b), respectively.

oxaspiro diselenide — Compound IIa

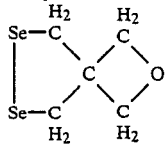

oxaspiro ditelluride — Compound IIb

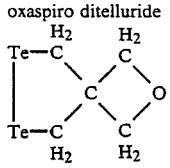

As illustrated by the examples below, the cyclic dichalcogenides defined hereinbefore exibit marked superiority as fog inhibiting agents over known dichalcogenide fog inhibiting agents. In addition, these compounds have been found to scavenge ambient peroxide. They are effective for that purpose when incorporated in the element as an antifoggant. In addition, they can be placed in an adjacent layer wherein they would intercept peroxide before it reaches the silver halide emulsion.

The cyclic dichalcogenide fog inhibiting agents are preferably incorporated in the photographic element to be protected prior to exposure and processing—e.g., at the time of manufacture. When the cyclic dichalcogenide is being relied upon to reduce fof the origin of which antedates processing, it is essential that the cyclic dichalcogenide be incorporated in the silver halide emulsion layer or layers to be protected. It is generally most convenient to introduce the cyclic dichalcogenide into the silver halide emulsion after chemical ripening of the emulsion and before coating.

When the cyclic dichalcogenide is intended to become active at the time of processing, it can be incorporated within the photographic element at any location which permits permeation of one or more silver halide emulsion layers being imagewise developed. For example, the cyclic dichalcogenide can be located in one or more silver halide emulsion layers or other hydrophilic colloid layers, such as in an overcoat, interlayer, or subbing layer. When the cyclic dichalcogenide is intended to become active at the time of processing, it is generally most convenient to add the cyclic dichalcogenide as a component of a processing solution, such as predevelopment bath or a developer, allowing it to permeate the silver halide emulsion layer or layers prior to or during development.

Any nonsensitizing amount of cyclic dichalcogenide effective to reduce fog can be employed. As is generally understood by those skilled in the art, when the effect of a fog inhibiting agent on a silver halide emulsion is examined as a function of its concentration, fog inhibition is observed to increase with increasing concentrations of the fog inhibiting agent. However, beyond a threshold concentration level photographic speed also decreases as a direct function of fog inhibiting agent concentration. Thus, maximum fog inhibiting agent concentrations are chosen to balance fog inhibition against speed loss. To avoid excessive speed loss fog inhibiting agent concentrations herein contemplated are in every instance less than 5 usually less than 1 millimole per mole of silver in the radiation sensitive silver halide emulsion layer.

If very low levels of fog inhibiting agent are employed, less than full fog inhibition is realized, and, depending upon the choice of fog inhibiting agent, an actual increase in photographic speed can be observed attributable to the presence of the fog inhibiting agent. Thus, achieving optimum fog inhibition and photographic sensitization with a fog inhibition agent are incompatible. The useful concentrations of fog inhibiting agents herein contemplated are in every instance greater than minimal threshold fog inhibiting concentrations that give rise to sensitization—i.e, an observable photographic speed increase. Stated another way, only nonsensitizing concentrations of the fog inhibiting agents employed in the practice of this invention are contemplated.

Optimum amounts of fog inhibiting agents for specific applications are usually determined empirically by varying concentrations. Such investigations are typically relied upon to identify optimum fog reduction concentrations or an optimum balance between fog reduction and other effects, such as reduction in photographic speed. Based on the investigations reported below, when the cyclic dichalcogenide is incorporated in a silver halide emulsion prior to coating, concentrations of at least about 0.05 millimole per silver mole in the radiation sensitive silver halide emulsion layer of incorporation is contemplated. A preferred minimum concentration of the fog inhibiting agent when incorporated in a radiation sensitive silver halide emulsion is 0.1 millimole per silver mole. It is to be noted that the cyclic dichalcogenides exhibit fog inhibiting activities that correspond to those of conventional aromatic disulfide and diselenide fog inhibiting agents employed at approximately an order of magnitude higher concentration levels. When the cyclic dichalcogenide is incorporated in a processing solution, concentration ranges from minimum effective amounts—e.g., typically at least 0.05 millimole per liter—to up to about 0.5 millimole per liter are contemplated.

It is, of corse, recognized that conventional fog inhibiting agents, such as those illustrated by *Research Disclosure, Item* 17643, Section VI, cited above, can be employed in combination with cyclic dichalcogenide in the practice of this invention. Since it is recognized that fog inhibiting agents operate by a variety of differing mechanisms, the effects produced by combinations of cyclic dichalcogenide and conventional fog inhibiting agents will range from highly interdependent to independently additive, but in any case optimum concentrations are susceptible to empirical determination.

In addition to the fog inhibiting agent this invention additionally requires a photographic element containing a radiation sensitive silver halide emulsion. These silver halide emulsions can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains of either regular (e.g., cubic or octahedral) or irregular (e.g., multiply twinned or tabular) crystallographic form. Recently developed high aspect ratio tabular grain emulsions, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,643,964, are specifically contemplated. Sensitizing compounds, such as compounds of copper, thallium, lead, bismuth, cadmium and Group VIII noble metals, can be present during precipitation of the silver halide emulsion, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709 and Rosecrants et al U.S. Pat. No. 3,737,313.

The silver halide emulsions can be either monodisperse or polydisperse as precipitated. The grain size distribution of the emulsions can be controlled by silver halide grain separation techniques or by blending silver halide emulsions of differing grain sizes. The emulsions can include Lippmann emulsions and ammoniacal emulsions, as illustrated by Glafkides, *Photographic Chemistry,* Vol. 1, Fountain Press, London, 1958, pp. 365–368 and pp. 301–304; excess halide ion ripened emulsions as described by G. F. Duffin, *Photographic Emulsion Chemistry,* Focal Press Ltd., London, 1966, pp. 60–72; thiocyanate ripened emulsions, as illustrated by Illingsworth U.S. Pat. No. 3,320,069; thioether ripened emulsions, as illustrated by McBride U.S. Pat. No. 3,271,157, Jones U.S. Pat. No. 3,574,628 and Rosecrants et al U.S. Pat. No. 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

The emulsions can be surface—sensitive emulions—i.e., emulsions that form latent images primarly on the surfaces of the silver halide grains—or internal latent image—forming emulsions—i.e., emulsions, that form latent images predominantly in the interior of the silver halide grains, as illustrated by Knott et al U.S. Pat. No. 2,456,953, Davey et al U.S. Pat. No. 2,592,250, Porter et al U.S. Pat. Nos. 3,206,313 and 3,317,322, Bacon et al U.S. Pat. No. 3,447,927, Evans U.S. Pat. No. 3,761,276, Morgan U.S. Pat. No. 3,917,485, Gilman et al U.S. Pat. No. 3,979,213, Miller U.S. Pat. No. 3,767,413, and Evans et al U.S. Pat. No. 4,504,570.

The emulsions can be negative—working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent, as illustrated by Ives U.S. Pat. No. 2,563,785, Evans U.S. Pat. No. 3,761,276, Knott et al U.S. Pat. No. 2,456,953, Jouy U.S. Pat. No. 3,511,662, and Evans et al U.S. Pat. No. 4,504,570.

Blends of surface sensitive emulsions and internally fogged, internal latent image-forming emulsions can be employed, as illustrated by Luckey et al U.S. Pat. Nos. 2,996,382, 3,397,987 and 3,705,858, Luckey U.S. Pat. No. 3,695,881, *Research Disclosure,* Vol. 134, June 1975, Item 13452, Millikan et al Defensive Publication T-904017, Apr. 21, 1972 and Kurz *Research Disclosure,* Vol. 122, June 1974, Item 12233.

The cyclic dichalcogenide compounds are preferably employed to reduce fog in negative working silver halide emulsions and most preferably those that contain silver halide grains which form surface latent images on exposure.

The silver halide emulsions can be surface sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosure,* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., latices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelation (pigskin gelatin), gelatin derivatives—e.g., acetylated gelatin, phthalated gelatin, and the like, polysaccharides such as dextran, gum arabic, zein, casein, pectin, collagen derivatives, collodion, agar—agar, arrowroot, and albumin. The vehicles can be hardened by conventional procedures. Further details of the vehicles and hardeners are provided in *Research Dislosure,* Item 17643, cited above, Sections IX and X.

The silver halide photographic elements of this invention can contain other addenda conventional in the photographic art. Useful addenda are described, for example, in *Research Disclosure, Item* 17643, cited above. Other conventional useful addenda include desensitizers, couplers (such as dye forming couplers, masking couples and DIR couplers) DIR compounds, anti-stain agents, image dye stabilizers, absorbing materials such as filter dyes and UV absorbers, light scattering materials, antistatic agents, coating aids, plasticizers and lubricants, and the like.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred color photographic element according to this invention comprises a support bearing at least one blue sensitive silver halide emulsion layer having associated therewith a yellow dye forming coupler, at least one green sensitive silver halide emulsion layer having associated therewith a magenta dye forming coupler and at least one red sensitive silver halide emulsion layer having associated therewith a cyan dye forming coupler, at least one of the silver halide emulsion layers containing an cyclic dichalcogenide fog inhibiting compound.

The elements of the present invention can contain additional layers conventional in photographic elements, such as overcoat layers, spacer layers, filter layers, antihalation layers, scavenger layers and the like. The support can be any suitable support used with photographic elements. Typical supports include polymeric films, paper (including polymer-coated paper), glass and the like. Details regarding supports and other layer of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated by *Research Disclosure,* Vol. 184, August 1979, Item 18431.

Processing of the imagewise exposed photographic elements in the presence of the cyclic dichalcogenide need not differ from conventional processing. Processing procedures, developing agents, and development modifiers are illustrated by *Research Disclosure,* Item 17643, cited above, Sections XIX, XX, and XXI, respectively. In its preferred application the invention relates to silver halide photographic elements which are processed in aqueous alkaline developers in the presence of the cyclic dichalcogenide.

A general scheme for synthesis of compounds useful in this invention is as follows:

One can start with a precursor to the compounds of formula I which has the formul A-I:

$$ZCH_2—C(R_1,R_2)—CH_2Z \qquad \text{A-I}$$

wherein Z represents a leaving group, such as a halide (Cl, Br, I) or a sulfonyl ester (—OSOZR′ where R′ is 4-tolyl, 4-bromophenhyl, methyl, or the like.) Reaction of this precursor with one equivalent of a suitable benzylchalcogenide anion (e.g., $C_6H_5—CH_2Se—$, $C_6H_5CH_2—S—$, $C_6H_5CH_2—Te—$) will give the monosubstituted species B-I:

$$C_6H_5CH_2—X—CH_2—C(R_1,R_2)—CH_2Z \qquad \text{B-I}$$

The benzylchalcogenide anions are most conveniently obtained by reduction of the corresponding dichalcogenides $(C_6H_5CH_2—X)_2$ using, e.g., borohydride.

A second reaction on compounds B-I using the same or a different benzylchalcogenide anion will yield compounds C-I:

$$C_6H_5CH_2—X—C(R_1,R_2)—X—CH_2C_6H_5 \qquad \text{C-I}$$

Debenzylation of species C-I using sodium in liquid ammonia, followed by oxidation, either using the proper stoichiometry of a common oxidant (e.g., iodine, peroxide, perchlorate) or simply air, will result in a ring closure reaction to compound of formula I.

Some specific compounds of this invention can be prepared by following procedures described on pages 399, 400, 401 and 416 of Organic Selenium Compounds: Their Chemistry and Biology, edited by Daniel L. Klayman and Wolfgang H. H. Gunther, 1973, Wiley-Interscience, New York, I5BN O-471-49032-6).

Compound (I-a) can be prepared by reaction of 2,2-dimethyl-1,3-propanediselenocyanate with sodium ethoxide:

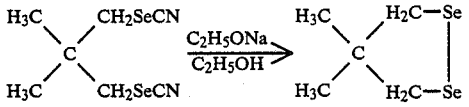

Compound (I-b) can be prepared by the reaction of 1,3-dibromo-2-methyl-2-phenylpropane with potassium selenide:

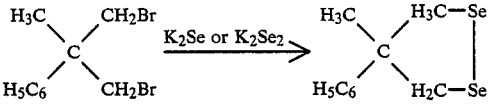

Compound (I-c) can be prepared by treatment of 2,2-bis(iodo-methyl)propane-1,3-diol or the analogous dichloro compound with sodium diselenide

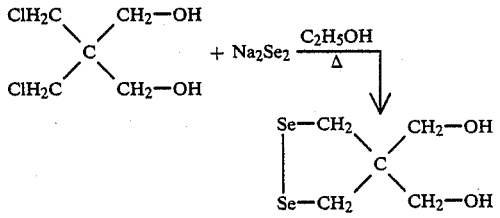

Compound (1-d) can be prepared by a ring-expansion reaction on heating 2-thiaspiro[3.5]nonane with selenium indiethylene glycol containing a trace of potassium cyanide:

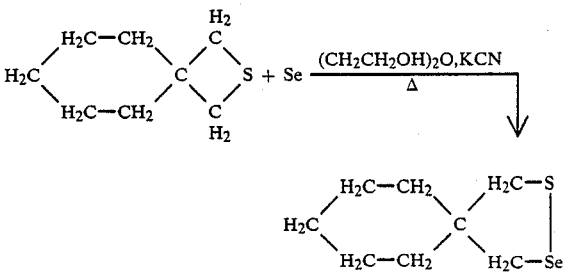

Compound (I-e) can be prepared by heating cyclohexene-1,1-dimethylbenzenesulfonate with potassium selenocyanate:

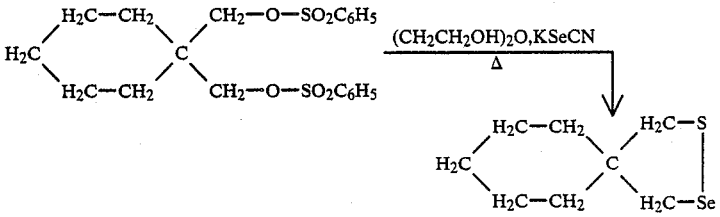

Other compounds within the scope of this invention can be prepared by analogous procedures. Günther et al., Ann. N.Y. Acad. Sci., 192, 25–43, (1972), cited above, describes the preparation of 2-oxa-6,7-diselenaspiro[3,4]-octane, i.e., Compound (II-a) of this invention.

Preparation of the cyclic oxaspiro ditelluride can be achieved, in one approach, by the procedure described below:

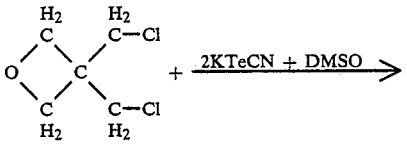

3

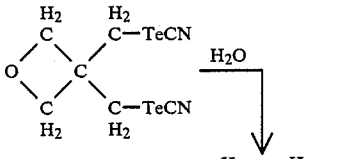

4

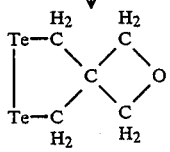

(IIb)

Compound (IIb) was prepared utilizing 3,3-bis(-chloromethyl)oxetane 3. The reagent used was potassium tellurocyanide in dimethylsulfoxide (DMSO) solution, formed by combining and heating potassium cyanide and elemental tellurium in DMSO. The 3,3-bis-(cyanotelluromethyl)oxetane intermediate, 4, ring closed to form the cyclic ditelluride, Compound (IIb). The presence of water appears to be essential for the ring closure reaction to proceed. The synthesis proceeded in a single step, as is shown the following detailed synthesis description.

Preparation of 2-oxa-6, 7-ditelluraspiro[3,4]octane (Cpd. II-b)

Elemental tellurium (5.1 g., 0.04 mol) and potassium cyanide (2.6 g., 0.04 mol.) were suspended in dimethyl sulfoxide (DMSO) (50 ml.) and heated under nitrogen at about 100° C. until all tellurium was dissolved (about one hour was required). After cooling, a solution of 3,3-bis-(chloromethyl)oxetane (3.1 g., 0.05 mol.) in DMSO (25 ml) was added and the resulting new solution was stirred overnight. It was heated to form a deep brown slurry. More brown solid formed on cooling and the addition of water. It was isolated by filtration and dried. The product was recrystallized from boiling ethanol. Crystals with a purple sheen separated from the bright blue solution. Addition of water to the filtrate yielded more crystals. The total yield was 5.1 g. which was 65% of the theoretical yield. A 1.7 g sample was recrystallized from boiling cyclohexane (300 ml.). Carbon, hydrogen, oxygen and tellurium elemental analysis was in agreement with the structure assigned. The nuclear magnetic resonance and mass spectra also supported the assigned structure. mp=171°-172° C. λ-max in methanol solution is at 660 nm with a shoulder at 580 nm. ε-max at 660=271 and at 580=223. The Raman spectrum showed Te-Te bands, one at 181 $cm^{-1}$ and the other at 191 $cm^{-1}$ (overtones at 363 $cm^{-1}$ and 376 $cm^{-1}$, respectively).

The following examples further illustrate the invention.

EXAMPLES 1 THROUGH 4

The superior fog inhibiting activity of the oxaspiro diselenides represented by Compound (II-a) of this invention over known dichalcogenide antifoggants is shown in Table I. These compounds were evaluated in a polydisperse sulfur plus gold sensitized silver bromoiodide emulsion. The compounds were added at the levels indicated and coated on cellulose acetate support to achieve a silver coverage of 4.89 $g/m^2$ and a gelatin coverage of 11.09 $g.m^2$. Samples of the coatings were exposed to a tungsten light source in an Eastman 1B Sensitometer through a wedge spectrograph. The coatings were developed for five minutes in a hydroquinone-Elon ® (p-aminophenol hemisulfate) developer, fixed, washed and dried. Samples of each of the coatings were incubated for two weeks at 49° C. under 50 percent relative humidity before being exposed and processed as described above. A characteristic (density vs. log exposure) curve was plotted for each coating. The sensitivity and fog data was determined from these curves. The results are recorded in Table I.

The data in Table I demonstrate superior fog inhibiting activity of the oxaspiro diselenides over the control compounds. It is further noted that the fog ihhibiting effects produced by the oxaspiro diselenides are superior to the fog inhibiting effects produced by the control compounds even when the oxaspiro diselenides are present at an order of magnitude lower concentration levels.

TABLE I

| | | Fog Inhibiting Activity | | | | |
|---|---|---|---|---|---|---|
| | | | Fresh | | Incubation | |
| Structure | Compound | Level mg/ mole Ag | Relative Sensitivity | Fog | Relative Sensitivity | Fog |
| Control | — | — | 100 | 0.14 | 43 | 0.80 |
| Invention Cpd. | (II-a) | 0.2 | 87 | 0.14 | 62 | 0.52 |
| | | 20 | 53 | 0.09 | 58 | 0.52 |
| 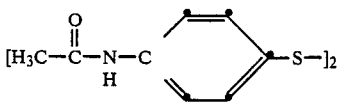 | (C-1) | 10 | 94 | 0.13 | 82 | 0.66 |
| | | 500 | 44 | 0.18 | 105 | 0.22 |
| 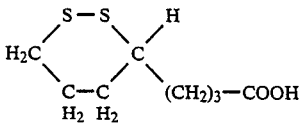 | (C-2) | 100 | 94 | 0.15 | 58 | 0.68 |
| | | 3000 | 68 | 0.10 | 105 | 0.11 |

The data in Table I demonstrate the superior fog inhibiting activity of the oxaspiro diselenide of the invention over known cyclic and acyclic disulfide antifoggants. It is further noted that the fog inhibiting effects produced by the oxaspiro diselenide are superior to the fog inhibiting effects produced by the control compounds even when the oxaspiro diselenide is present at orders of magnitude lower concentration levels.

EXAMPLES 5 THROUGH 10

The procedure of the preceding examples was repeated, but with lower concentration levels of the oxaspiro dichalcogenides present in the emulsion layers. Their activity is recorded in Table II. It is apparent that the compounds of the invention produce superior fog and speed/for relationships even at concentrations of orders of magnitude lower than those of known acyclic disulfide, diselenide, and ditelluride antifoggants.

TABLE II

| | | Fog Inhibiting Activity | | | | |
|---|---|---|---|---|---|---|
| | | | Fresh | | Incubation | |
| Structure | Compound | Level mg/ mole Ag | Relative Sensitivity | Fog | Relative Sensitivity | Fog |
| Control | — | — | 100 | 0.10 | 40 | 0.54 |

TABLE II-continued

| Structure | Compound | Fog Inhibiting Activity: Fresh: Level mg/mole Ag | Fresh: Relative Sensitivity | Fresh: Fog | Incubation: Relative Sensitivity | Incubation: Fog |
|---|---|---|---|---|---|---|
| Invention Cpd. | (II-a) | $8.26 \times 10^{-4}$ | 93 | 0.10 | 50 | 0.48 |
| | | $8.26 \times 10^{-3}$ | 85 | 0.07 | 80 | 0.23 |
| " | (II-b) | $8.26 \times 10^{-4}$ | 95 | 0.07 | 63 | 0.35 |
| | | $8.26 \times 10^{-3}$ | 54 | 0.06 | 63 | 0.09 |
| see Example I | (C-1) | 0.06 | 55 | 0.06 | 71 | 0.30 |
| | | 0.20 | 54 | 0.05 | 74 | 0.22 |
| 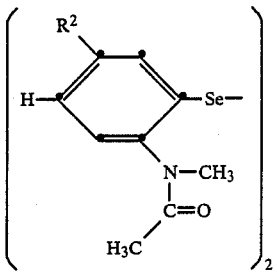 | (C-4) | 0.06 | 95 | 0.08 | 63 | 0.33 |
| | | 0.20 | 82 | 0.07 | 69 | 0.11 |
| 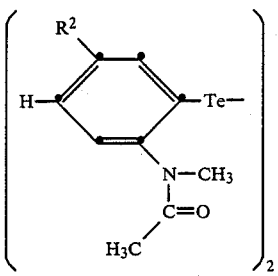 | (C-5) | 0.06 | 78 | 0.07 | 83 | 0.08 |
| | | 0.20 | 40 | 0.05 | 26 | 0.04 |

This invention has been described in detail with reference to preferred embodiments thereof, but it will be understood that variations and modifications can be effected within the spirit and scope of the invention.

What is claimed is:

1. A photographic element containing a radiation-sensitive silver halide emulsion and a nonsensitizing amount of a fog inhibiting agent having the general formula:

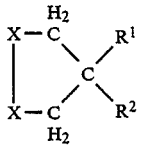

wherein each X represents a divalent sulfur, selenium or tellurium atom, at least one X is either a selenium or a tellurium atom;

$R^1$ and $R^2$ each independently represent substituted or unsubstituted alkyl, aralkyl or aryl group having from 1 to 20 carbon atoms or $R^1$ and $R^2$ together form a cyclic alkylene or ether group having from 1 to 20 carbon atoms.

2. A photographic element according to claim 1 further characterized in that said silver halide emulsion contains surface latent image forming silver halide grains.

3. A photographic element according to claim 2 further characterized in that said silver halide grains are surface chemically sensitized.

4. A photographic element according to claim 2 further characterized in that said silver halide grains are spectrally sensitized.

5. A photographic element according to claim 1 further characterized in that each X is a selenium or a tellurium atom.

6. A photographic element according to claim 1 further characterized in that said fog inhibiting agent is incorporated in said silver halide emulsion.

7. A photographic element according to claim 6 further characterized in that said fog inhibiting agent is present in a concentration of less than 1.0 millimole per silver mole.

8. A photographic element according to claim 7 further characterized in that said fog ihhibiting agent is present in a concentration of at least 0.05 millimole per silver mole.

9. A photographic element according to claim 1 further characterized in that the fog inhibiting agent has the formula:

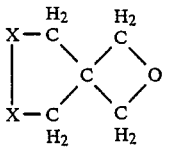

wherein each X represents a divalent selenium or tellurium atom.

* * * * *

UNITED STATES PATENT AND TRADEMARK OFFICE

CERTIFICATE OF CORRECTION

PATENT NO. : 4,861,703

DATED : August 29, 1989

INVENTOR(S) : R. Lok et al.

It is certified that error appears in the above-identified patent and that said Letters Patent is hereby corrected as shown below:

Column 14, after claim 9, insert the following:

--10. A photographic element according to claim 9 wherein the fog inhibiting agent is 2-Oxa-6,7-ditelluraspiro[3,4]octane.--

Signed and Sealed this

Twenty-first Day of May, 1991

*Attest:*

HARRY F. MANBECK, JR.

*Attesting Officer*

*Commissioner of Patents and Trademarks*